US007688268B1

(12) United States Patent
West et al.

(10) Patent No.: US 7,688,268 B1
(45) Date of Patent: Mar. 30, 2010

(54) MULTI-BAND ANTENNA SYSTEM

(75) Inventors: James B. West, Cedar Rapids, IA (US); Lee M. Paulsen, Cedar Rapids, IA (US); Daniel N. Chen, Diamond Bar, CA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 3 days.

(21) Appl. No.: 11/494,227

(22) Filed: Jul. 27, 2006

(51) Int. Cl.
*H01Q 13/00* (2006.01)

(52) U.S. Cl. ..... 343/776; 343/770; 343/872

(58) Field of Classification Search ..... 343/767, 343/770, 700 MS, 771, 772, 776, 872
See application file for complete search history.

(56) References Cited

U.S. PATENT DOCUMENTS

| | | | | |
|---|---|---|---|---|
| 5,845,391 | A * | 12/1998 | Bellus et al. | 29/600 |
| 2004/0180707 | A1* | 9/2004 | Barrett | 455/575.9 |
| 2005/0007286 | A1* | 1/2005 | Trott et al. | 343/770 |
| 2006/0273974 | A1* | 12/2006 | Bij De Vaate et al. | 343/770 |
| 2007/0030209 | A1* | 2/2007 | Artis et al. | 343/770 |
| 2007/0296639 | A1* | 12/2007 | Hook et al. | 343/767 |
| 2008/0136731 | A1* | 6/2008 | Wu et al. | 343/872 |

* cited by examiner

*Primary Examiner*—Trinh V Dinh
*Assistant Examiner*—Dieu Hien T Duong
(74) *Attorney, Agent, or Firm*—Daniel M. Barbieri

(57) ABSTRACT

The present invention is an improved antenna system. In an embodiment of the invention, the antenna system of the present invention may be a high-gain, low-profile wide-band antenna. Advantageously, the antenna system of the present invention may include a plate with reflecting elements to form a reflectarray antenna suitable for mounting on an aircraft. The reflectarray antenna of the present invention may be formed from a planar array of waveguides which may operate as a low loss, wide-band reflecting elements. Individual waveguides may be designed to scatter an incident field while impressing appropriate phase shifts in order to form a plane wavefront at the array aperture to produce a desired output signal. Waveguides may include ridges to employ vertical and horizontal polarization across a wide bandwidth operable at a high frequency, such as 10 GHz to 30 GHz.

19 Claims, 5 Drawing Sheets

MULTI-BAND ANTENNA SYSTEM

FIELD OF THE INVENTION

The present invention relates generally to antenna technology, and more particularly to a multi-band antenna system.

BACKGROUND OF THE INVENTION

The proliferation of satellite imagery, electronic data transfer and electronic data storage has increased demand for multi-media connectivity for military and commercial aircraft applications. In a military application, real-time surveillance imagery obtained from manned and un-manned aircraft may be passed to ground troops through satellite communication. In commercial aircraft applications, many passengers of a commercial aircraft flight desire to work while on-board the flight. In order to fulfill this demand, airliners have begun offering multi-media access to aircraft passengers through satellite communication.

Conventional on-board aircraft antenna systems for satellite communication are limited in many ways. For example, a conventional antenna system may include a horn antenna with a dielectric lens. A drawback associated with the horn antenna and dielectric lens system is the weight and large form factor occupied by the horn antenna in order to receive satellite communication in high frequency bands, such as the $K_u$ and $K_a$ bands. A heavy and large form factor antenna system mounted on an aircraft may affect the response and maneuverability of the aircraft, as well as increase the mechanical load on, and subsequent cost of, the positioning unit. Additionally, a conventional antenna system for satellite communication may only support a limited bandwidth. For example, a conventional on-board aircraft antenna system may be limited to receiving satellite communication in the $K_a$ band. In order to receive communication in the $K_u$ band, a separate antenna and receiver system may be required, which further increases the weight, profile and form factor of the aircraft communication system. Consequently, an improved antenna system is necessary.

SUMMARY OF THE INVENTION

Accordingly, the present invention is directed to an improved antenna system. In an embodiment of the invention, the antenna system of the present invention may be a high-gain, low-profile, wide-band antenna. Advantageously, the antenna system of the present invention may be formed as a plate providing a lightweight and low-cost structure having a planar profile which may be suitable for mounting on an aircraft. The plate may include a planar array of waveguides which may operate as low loss, wide-band reflecting elements to create a reflectarray antenna. Individual waveguides may be designed to scatter an incident field while impressing appropriate phase shifts in order to form a plane wavefront at the array aperture to produce a desired collimated signal. Additionally, waveguides may include multiple ridges to employ vertical and horizontal polarization across a wide bandwidth operable at a high frequency, such as 10 GHz to 30 GHz.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to a presently preferred embodiment of the invention, an example of which is illustrated in the accompanying drawings.

Referring generally to FIGS. 1-5, an embodiment of an antenna system in accordance with the present invention is shown. The antenna system of the present invention may be a high-gain, low-profile, wide-band antenna. Advantageously, the antenna system of the present invention may be formed as as a plate providing a flat profile, lightweight and low-cost structure which may be suitable for mounting on an aircraft. The plate may include a planar array of waveguides which may operate as low loss, wide-band reflecting elements to create a reflectarray antenna. Individual waveguides may be designed to scatter an incident field while impressing appropriate phase shifts in order to form a phase front at the array aperture to produce a desired collimated beam in the far field. Waveguides may include ridges to employ vertical and horizontal polarization across a wide bandwidth operable at a high frequency, such as 10 GHz to 30 GHz.

Figure 1:
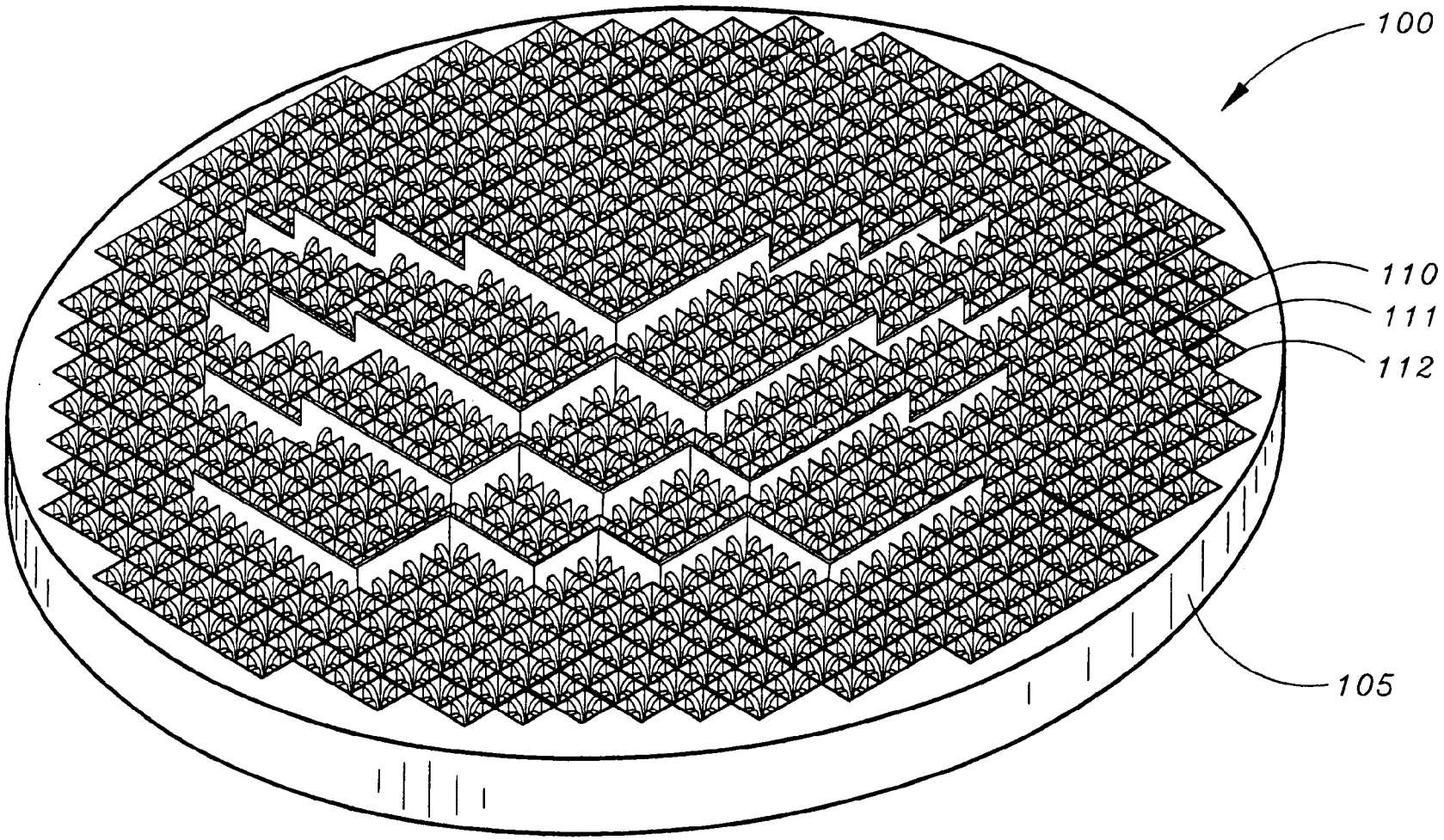
FIG. 1 depicts an antenna system in accordance with an embodiment of the present invention.

Referring specifically to FIG. 1, an antenna system 100 in accordance with an embodiment of the present invention is shown. Antenna system 100 may include a plate 105 and a plurality of waveguides 110-112. Plate 105 may be formed of metal wherein each of the waveguides 110-112 may be machined within the metal. Alternatively, plate 105 may comprise a lightweight rigid material which includes a metal covering. It is contemplated that the surface of the plate and waveguides may be a reactive surface. The surface reactance and the ratio of cosines from a source to a point in plane may be adjusted to allow reflection of electromagnetic radiation. By imposing desired phase shifts to the reflected radiation, beam collimation may be achieved. Beam collimation may refer to the direction of radio waves in a concentrated and parallel stream. Through beam collimation, the antenna system 100 may generate a gain in reception and transmission of electromagnetic radiation.

It is contemplated that antenna system 100 may be a reflectarray antenna. A reflectarray antenna may be a low profile antenna which includes a grounded flat array of resonant conducting elements and a primary source. In an embodiment of the invention, the resonant conducting elements may be formed from the plurality of reflecting waveguides 110-112.

Figure 2:
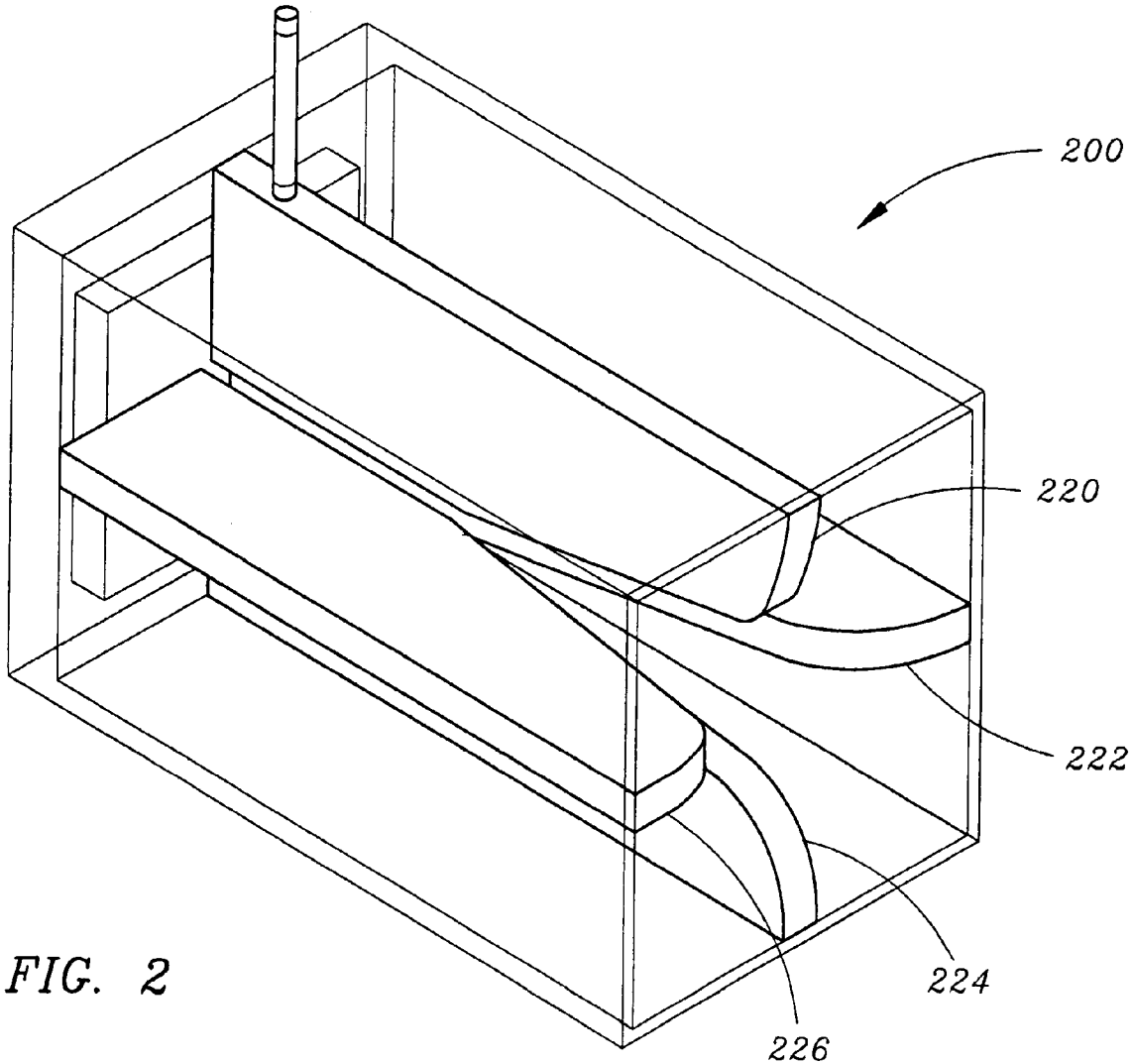
FIG. 2 depicts an exemplary waveguide in accordance with an embodiment of the present invention.

Antenna system 100 may be well-suited for aircraft applications. Due to its planar form factor, antenna system 100 may be mounted to an aircraft in a low-profile manner. Additionally, since aircraft may be in motion and the relative angles of elevation and azimuth may be changing, the antenna system 100 may be mounted with a two axis motor for mechanical scanning in azimuth and elevation. Referring to FIG. 2, an exemplary waveguide 200 in accordance with an embodiment Antenna system 100 of the present invention is shown. Waveguide 200 may be representative of waveguides 110-112 of FIG. 1. Waveguide 200 may refer to an apparatus for guiding waves, such as electromagnetic waves. Waveguide 200 may operate as a low loss, wide-band reflecting element. For example, waveguide 200 may operate at 10-12 GHz, 14-14.5 GHz, 20 GHz and 30 GHz which may allow communication in the Ku and Ka bands. Additionally, waveguide 200 may operate simultaneously in the Ku and Ka bands without any mechanical altering or intervention of the waveguide 200.

Waveguide 200 may be a shorted waveguide, also known as a short circuited waveguide. A short circuited waveguide includes a metal or conductive plate covering the back opening of the waveguide, providing a continuous electrical path across the entire cross-section of the waveguide. A shorted waveguide may provide a convenient, discretized, surface reactance. It is contemplated that the length of individual waveguides 110-112 may be adjusted to provide a desired phase shift in order to create a collimated beam, or signal.

Figure 3:
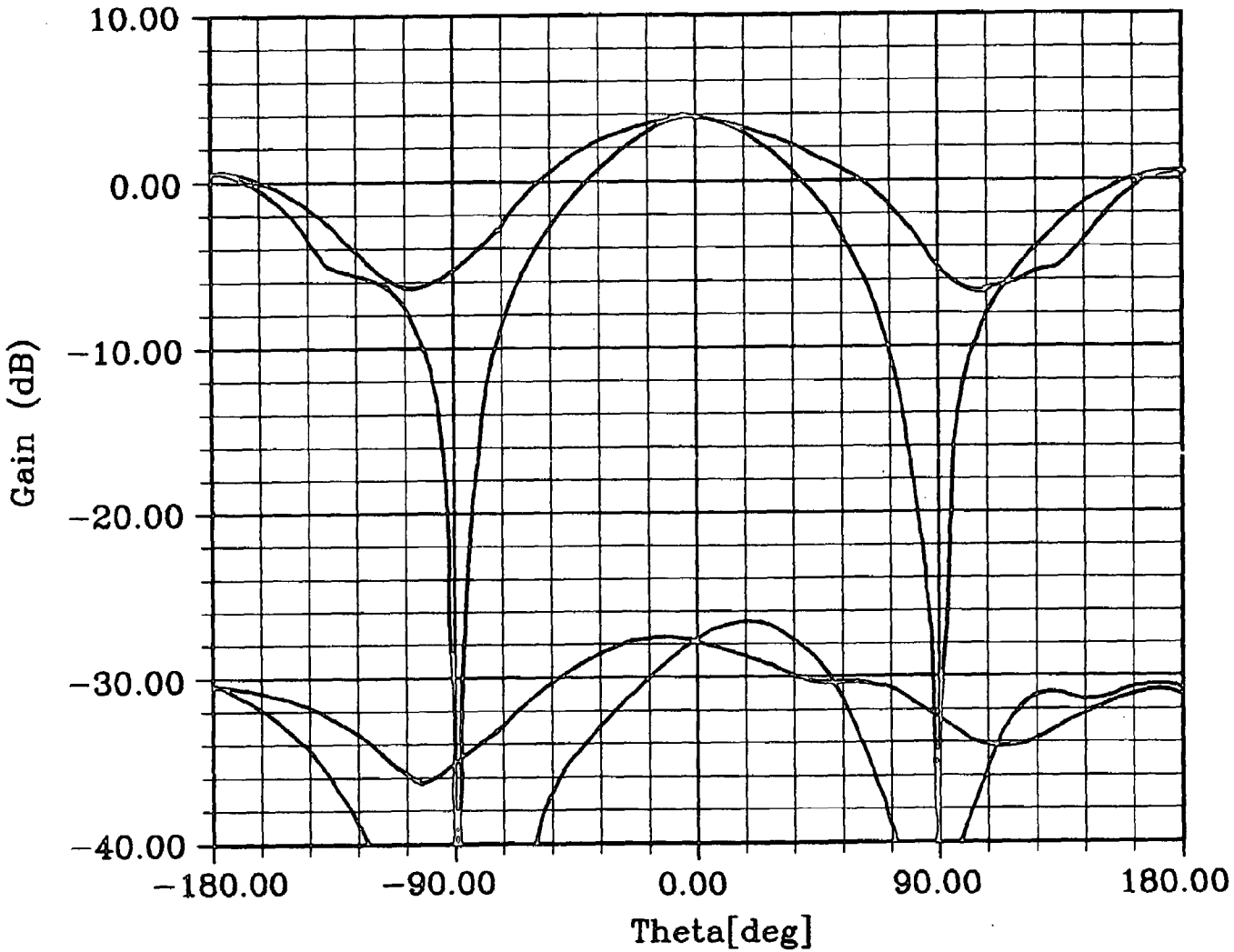
FIG. 3 depicts an exemplary gain of a 10 GHz signal of the antenna system of FIG. 1 in accordance with an embodiment of the present invention.
Figure 4:
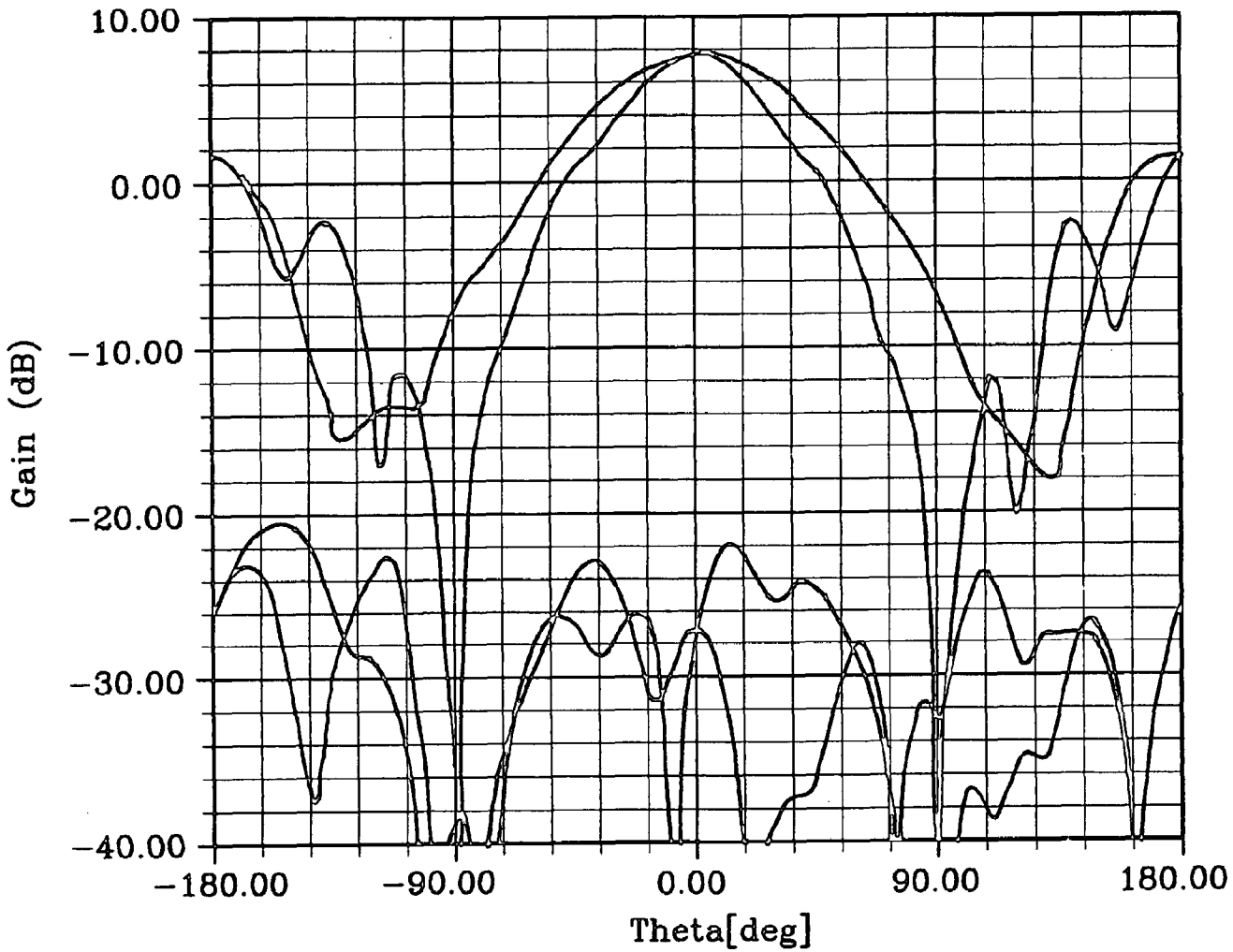
FIG. 4 depicts an exemplary gain of a 20 GHz signal of the antenna system of FIG. 1 in accordance with an embodiment of the present invention.
Figure 5:
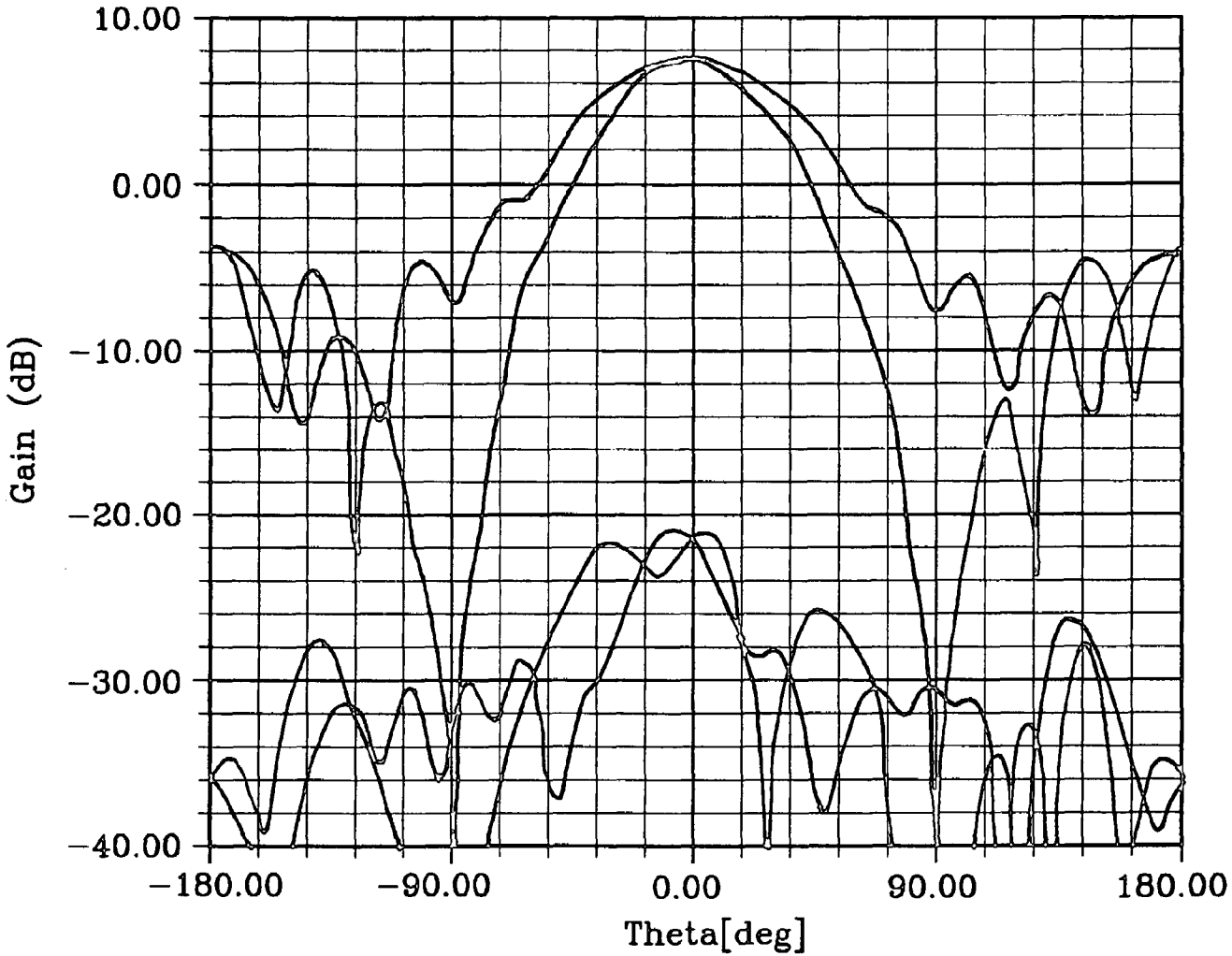
FIG. 5 depicts an exemplary gain of a 30 GHz signal of the antenna system of FIG. 1 in accordance with an embodiment of the present invention.

Waveguide 200 may be a rectangular waveguide. Waveguide 200 may include one or more ridges 220-226. Ridges 220-226 may be coupled to the interior portion of the waveguide whereby a ridge is coupled to each side of the waveguide 200. Waveguide 200 with ridges 220-226 may operate to lower the cutoff frequency of the waveguide 200 in comparison to a standard waveguide of similar dimensions. Additionally, waveguide 200 may sustain two linear and orthogonal polarization signals which allows reception and transmission of any type of polarized signal, including a vertical polarized wave, a horizontal polarized wave and a circularly polarized wave. As stated previously, it is contemplated that the length of individual waveguides 110-112 may be adjusted to provide a desired phase shift in order to create a collimated signal. Through generation of the collimated signal, a signal gain is generated with low loss across a wide bandwidth. Referring generally to FIGS. 3-5, the exemplary gain of the antenna system at 10 GHz, 20 GHz and 30 GHz is shown respectively.

The antenna system 100 of FIG. 1 provides a number of advantages. Antenna system may be operable between 10 GHZ and 30 GHz which allow operation in the Ku and Ka bands. This may allow access to a majority of the commercial Ku band satellite fleet that is currently operating, as well as the anticipated next generation of Ka band satellites. The antenna system 100 may be assembled with a lower weight, profile and form factor than conventional antenna systems, such as a horn antenna with dielectric lens. Additionally, the materials and manufacture associated with assembling antenna system 100 may cost less than conventional antenna systems.

While the antenna system 100 with waveguides has been described, it is contemplated that other types of reflecting elements may be employed and other configurations of waveguides may be employed without departing from the scope and intent of the present invention. For example, a waveguide with two ridges, also known as a double-ridge waveguide, may be utilized. Additionally, while the antenna system 100 is operable between 10 GHz and 30 GHz, it is contemplated that the antenna system 100 of FIG. 1 may be operable across other multi-bands without departing from the scope and intent of the present invention.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An antenna system, comprising:

a plate;

a plurality of rectangular waveguides formed within said plate, each of said plurality of rectangular waveguides including a plurality of ridges coupled to an interior portion of said each of said plurality of rectangular waveguides, wherein said plurality of waveguides reflect received signals to produce a collimated signal, a length of said each of said plurality of rectangular waveguides does not exceed a height of said plate, a length of said plurality of ridges does not exceed the length of said each of said plurality of rectangular waveguides, an axis of the length of said each of said plurality of rectangular waveguides is parallel to an axis of the height of said plate, the axis of the length of said each of said plurality of rectangular waveguides is parallel to an axis of the length of said plurality of ridges, the axis of the length of said each of said plurality of rectangular waveguides is approximately parallel to said collimated signal, the axis of the height of said plate is parallel to the axis of the length of said plurality of ridges, the axis of the height of said plate is approximately parallel to said collimated signal, and the axis of the length of said plurality of ridges is approximately parallel to said collimated signal.

2. The antenna system as claimed in claim 1, wherein said plate is formed of metal.

3. The antenna system as claimed in claim 1, wherein said plate is formed of a rigid material and includes a metal covering.

4. The antenna system as claimed in claim 1, wherein a portion of said plurality of rectangular waveguides impress a phase shift upon received signals for producing said collimated signal.

5. The antenna system as claimed in claim 4, wherein a length of a rectangular waveguide of said plurality of rectangular waveguides determines a quantity of phase shift.

6. The antenna system as claimed in claim 1, wherein said each of said plurality of rectangular waveguides includes four ridges.

7. The antenna system as claimed in claim 1, wherein said antenna system radiates linear polarization and circular polarization.

8. The antenna system as claimed in claim 1, wherein each of said plurality of rectangular waveguides is operable between 10 GHz and 30 GHz and wherein the antenna system is operable in Ku and Ka bands.

9. An antenna system, comprising:

a plate;

a plurality of rectangular waveguides formed within said plate, each of said plurality of rectangular waveguides including four ridges coupled to an interior portion of said each of said plurality of rectangular waveguides, wherein said plurality of rectangular waveguides reflect received signals to produce a collimated signal and impress a phase shift upon said received signals for producing said collimated signal, a length of said each of said plurality of rectangular waveguides does not exceed a height of said plate, a length of said plurality of ridges does not exceed the length of said each of said plurality of rectangular waveguides, an axis of the length of said each of said plurality of rectangular waveguides is parallel to an axis of the height of said plate, the axis of the length of said each of said plurality of rectangular waveguides is parallel to an axis of the length of said plurality of ridges, the axis of the length of said each of said plurality of rectangular waveguides is approximately parallel to said collimated signal, the axis of the height of said plate is parallel to the axis of the length of said plurality of ridges, the axis of the height of said plate is approximately parallel to said collimated signal, and the axis of the length of said plurality of ridges is approximately parallel to said collimated signal.

10. The antenna system as claimed in claim 9, wherein said plate is formed of metal.

11. The antenna system as claimed in claim 9, wherein said plate is formed of a rigid material and includes a metal covering.

12. The antenna system as claimed in claim 9, wherein a length of a rectangular waveguide of said plurality of rectangular waveguides determines a quantity of phase shift.

13. The antenna system as claimed in claim 9, wherein said antenna system radiates linear polarization and circular polarization.

14. The antenna system as claimed in claim 9, wherein each of said plurality of rectangular waveguides is operable between 10 GHz and 30 GHz and wherein the antenna system is operable in Ku and Ka bands.

15. A reflectarray antenna, comprising:

a plate;

a plurality of rectangular waveguides formed within said plate, each of said plurality of rectangular waveguides including four ridges coupled to an interior portion of said each of said plurality of rectangular waveguides, wherein said plurality of rectangular waveguides reflect received signals to produce a collimated signal and impress a phase shift upon received signals for producing said collimated signal, a length of said each of said plurality of rectangular waveguides does not exceed a height of said plate, a length of said plurality of ridges does not exceed the length of said each of said plurality of rectangular waveguides, said each of said plurality of rectangular waveguides being operable between 10 GHz and 30 GHz, an axis of the length of said each of said plurality of rectangular waveguides is parallel to an axis of the height of said plate, the axis of the length of said each of said plurality of rectangular waveguides is parallel to an axis of the length of said plurality of ridges, the axis of the length of said each of said plurality of rectangular waveguides is approximately parallel to said collimated signal, the axis of the height of said plate is parallel to the axis of the length of said plurality of ridges, the axis of the height of said plate is approximately parallel to said collimated signal, and the axis of the length of said plurality of ridges is approximately parallel to said collimated signal;

wherein the reflectarray antenna is operable in Ku and Ka bands.

16. The reflectarray antenna as claimed in claim 15, wherein said plate is formed of metal.

17. The reflectarray antenna as claimed in claim 15, wherein said plate is formed of a rigid material and includes a metal covering.

18. The reflectarray antenna system as claimed in claim 17, wherein a length of a rectangular waveguide of said plurality of rectangular waveguides determines a quantity of phase shift.

19. The reflectarray antenna system as claimed in claim 15, wherein said reflectarray antenna radiates linear polarization and circular polarization.

* * * * *